US007466954B2

(12) United States Patent
Kasiske, Jr. et al.

(10) Patent No.: US 7,466,954 B2
(45) Date of Patent: Dec. 16, 2008

(54) IMAGE RECEIVER SHEET SURFACE CHARACTERISTICS FOR OPTIMUM SHEET HANDLING

(75) Inventors: Wilbur Charles Kasiske, Jr., Penfield, NY (US); David Daniel Putnam, Fairport, NY (US); Jiann-Hsing Chen, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 227 days.

(21) Appl. No.: 11/321,286

(22) Filed: Dec. 28, 2005

(65) Prior Publication Data

US 2007/0147916 A1 Jun. 28, 2007

(51) Int. Cl.
*G03G 15/20* (2006.01)

(52) U.S. Cl. ..... 399/341; 430/124.3; 430/124.51

(58) Field of Classification Search ..... 399/341, 399/320, 329; 430/124.3, 124.51; 219/216; 347/156

See application file for complete search history.

(56) References Cited

U.S. PATENT DOCUMENTS

| | | | | |
|---|---|---|---|---|
| 3,799,827 | A * | 3/1974 | Takimoto et al. | 430/124.3 |
| 5,265,536 | A * | 11/1993 | Millard | 101/424.2 |
| 6,950,615 | B2 * | 9/2005 | Jung et al. | 399/341 X |
| 2002/0102117 | A1 * | 8/2002 | Hauptmann | 399/341 |
| 2003/0031484 | A1 * | 2/2003 | Mills | 399/341 |
| 2005/0214004 | A1 * | 9/2005 | Toyohara et al. | 399/341 X |

* cited by examiner

*Primary Examiner*—Sophia S Chen
(74) *Attorney, Agent, or Firm*—Lawrence P. Kessler

(57) ABSTRACT

A receiver member is provided suitable for having an ultra-gloss, image print formed thereon, the receiver member having at least one planar surface, a plurality of standoffs protruding from the planar surface, the plurality of standoffs providing a coefficient of friction for the planar surface for substantially preventing similar stacked receiver members from sticking together, and without adversely affecting any print image thereon. A member is provided for creating a contour on the receiver member. The member includes a surface contoured to exhibit a plurality of valleys which will not adversely impact print image quality, wherein a reciprocal peaked contour is formed on the receiver member.

20 Claims, 2 Drawing Sheets

IMAGE RECEIVER SHEET SURFACE CHARACTERISTICS FOR OPTIMUM SHEET HANDLING

FIELD OF THE INVENTION

This invention relates in general to image receiver sheets for prints formed by electrographic reproduction apparatus, and more particularly to image receiver sheet characteristics providing optimum sheet handling in an electrographic reproduction apparatus.

BACKGROUND OF THE INVENTION

High glossed toner images are created by forming very smooth surfaces that minimize the amount of light diffusion off the surface. These extremely smooth surfaces, when placed against one another, can create significant problems in print handling. When two smooth surfaces are placed together, particularly as with duplex prints (although this is also somewhat true with simplex prints), the surface contact area between the prints is maximized. As air escapes from between the prints, which happens naturally over time or when pressed together, e.g., as in a cutter, the forces locking the prints together increases enough to prevent movement between the sheets and can create a solid "brick" of prints. Handling this type of output within the glossing equipment or in post processing equipment can be impossible. It is particularly noted that in practice there occurs poor stacking, inability to jog the prints, multi-feeding of prints in postal equipment, rejection of prints from the post office for poor handling in postal equipment.

After examining a number of print surfaces, it has been determined that those prints with micrometer sized raised features had the best sliding (and non-bricking) performance. In a typical glossing/fusing process mode utilizing a belt for effecting glossing/fusing, the desired belt features, which serve to create the raised print features are formed by the natural roughening that occurs in the glossing/fusing process. Unfortunately, it takes tens of thousand of glossed/fused sheets to get the desired glossing/fusing belt characteristics for optimum print sliding performance. The ideal performance may require a belt that has been aged by as many as 200,000 prints. Accordingly, it is the purpose of this invention to produce an ideal glossing/fusing belt with suitable surface features that eliminate fused prints from "bricking" together.

SUMMARY OF THE INVENTION

In view of the above, this invention is directed to producing an ideal glossing/fusing belt with surface features that eliminate fused prints from "bricking" together. With such belt features, the resulting print features that eliminate prints from bricking together can be accomplished at the same time as glossing/fusing at no additional cost. The preconditioning of the glossing/fusing belt surface can be accomplished using an abrasive surface. The roughening materials and processes used must provide the optimal belt surface for favorable handling, while maintaining overall image quality of the prints. If done correctly, acceptable sliding performance and high image quality is achieved immediately from a conditioned new belt.

This invention has three aspects:

1) it specifically defines what surface characteristics can eliminate/significantly reduce sticking or bricking of toner images while maintaining the highest, artifact free gloss level;

2) it teaches how ideal surface characteristics can be produced on the print surface using a belt fusing apparatus; and 3) it shows how the belt can be manufactured to achieve the specific features.

The desired features for optimum print-to-print contact, to avoid bricking range from approximately 3 to 25 micrometers in length, approximately 3 micrometers or greater in width, and approximately 0.05 micrometers or greater in height. To yield such features in the prints, similar sized features are formed on the glossing/fusing belt (but are, of course, indentations into the belt coating). During the process of glossing/fusing (heating/melting/cooling), the toner image on the print is cast to the surface of the belt and causes the formation of the desired features on the prints. Because the eye cannot resolve such small features, the image quality of the prints remains extremely high. The high gloss level of the prints is undisturbed, gloss haze increases only slightly, and no image artifacts are introduced.

Accordingly, with this invention, a receiver member is provided suitable for having an ultra-gloss, image print formed thereon, the receiver member having at least one planar surface, a plurality of standoffs protruding from the planar surface, the plurality of standoffs providing a coefficient of friction for the planar surface for substantially preventing similar stacked receiver members from sticking together, and without adversely affecting any print image thereon.

Further, according to this invention, a receiver member suitable for having an ultra-gloss image print formed thereon, is provided, the receiver member having at least one planar surface, a plurality of standoffs protruding from the planar surface, the plurality of standoffs providing a coefficient of friction for the planar surface for substantially preventing similar stacked receiver members from sticking together, and without adversely affecting any print image thereon.

Still further according to this invention, in a mechanism for forming ultra-glossy, print images on a receiver member, a member for creating a contour on the receiver member to substantially prevent stacked receiver members from sticking together while not adversely affecting the quality of the print images, the member including a surface contoured to exhibit a plurality of valleys which will not adversely impact print image quality, wherein a reciprocal peaked contour is formed on the receiver member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
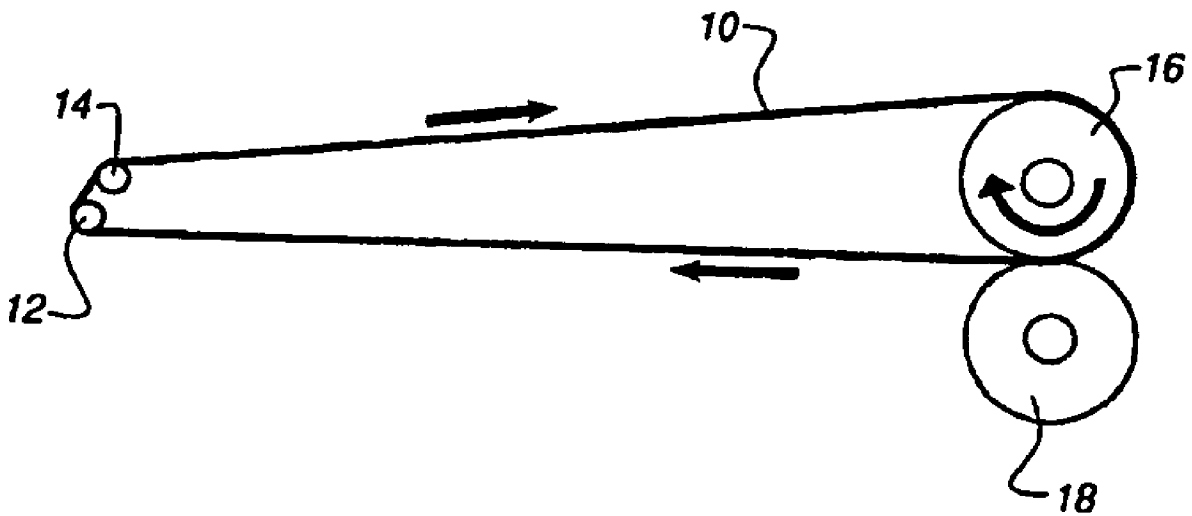
FIG. 1 is a schematic side elevation view of a glossing/fusing belt being conditioned to form desired features thereon, for impressing similar features on prints, according to this invention.

The preferred practice of this invention is to condition the surface of a new (or aged) glossing/fusing belt with suitable desired features such that similar desired surface features are formed on a print at the same time as the smooth glossy surface is produced thereon. Conditioning the surface of the belt, while maintaining the highest quality for glossing can be a challenge. The preferred method is to indent small hard particles into the surface to create valleys 3 to 25 micrometers in length, approximately 3 micrometers or greater in width, and approximately 0.05 micrometers or greater in height. The method currently being used to condition the belt utilizes the glosser hardware. Sandpaper is wrapped around the pressure roller. The pressure roller is then engaged with the glossing belt for 6 revolutions at a given load (10 mm nip width). With this method, the sticking/bricking solution is achieved and the image quality requirements are maintained.

Sample Preparation

Samples of glossing/fusing belts were prepared for optical examination and Veeco analysis by gold coating using a Denton DV-502A evaporator to make them reflective. The samples were coated to a thickness of 200 angstroms as measured with the Thickness Monitor DTM-100 (Sycon Instruments STM-100). The instrument used for the analysis was a Veeco NT8000 running on Vision software version 3.42. The 50× objective at 0.5 fov in the VSI mode (Vertical Scanning Interferometry) was used to collect the data.

A Multiple Regions Analysis routine was used to calculate the average valley height and average peak height. The conditions used are as follows:

| | |
|---|---|
| Minimum Region Size: | 20-30 pix |
| Region Level: | Valleys (for Member)<br>Peaks (for Receiver Member) |
| Terms Removal: | None |
| Zero Level: | Automatic |
| Region Finding Routine: | by threshold<br>20 nm or 10 nm for finer features |

TABLE 1

| | | | Surface Abrasive Characteristics | | | Forming Process Conditions | | | Member Characteristics | | |
|---|---|---|---|---|---|---|---|---|---|---|---|
| Sample | Member Forming Surface Abrasive | Mat'l. | Ra | Rz | Thickness | Nip Width | Nip Temp. | No. of Member Cycles | Avg. Valley Height | Diameter | #/mm$^2$ |
| Example 1 | Cushioned Cloth Abrasive Wrapped Around Pressure Roller | SiC | 7.3 | 20.2 | 0.43 | 10 | 80 | 4 | 0.041 | 4.5 | 75 |
| Example 2 | Cushioned Cloth Abrasive Wrapped Around Pressure Roller | SiC | 7.3 | 20.2 | 0.43 | 10 | 80 | 6 | 0.042 | 7.8 | 1150 |
| Example 3 | Cushioned Cloth Abrasive Wrapped Around Pressure Roller | SiC | 4.8 | 17.9 | 0.36 | 10 | 80 | 4 | — | — | — |
| Example 4* | Cushioned Cloth Abrasive Wrapped Around Pressure Roller | SiC | 4.8 | 17.9 | 0.36 | 10 | 80 | 6 | 0.028 | 5.4 | 7500 |
| Example 5* | Cushioned Cloth Abrasive Wrapped Around Pressure Roller | $Al_2O_3$ | 7.0 | 22.0 | 0.47 | 10 | 80 | 6 | 0.039 | 4.1 | 350 |
| Example 6 | Paper Abrasive Fed Between Member & Pressure Roller | $Al_2O_3$ | 3.9 | 17.4 | 0.20 | 9 | 135 | 2 | — | — | — |
| Example 7 | Paper Abrasive Fed Between Member & Pressure Roller | SiC | 3.7 | 15.9 | 0.15 | 12 | 135 | 1 | — | — | — |
| Example 8 | Pressure Roller Overcoat | $Al_2O_3$ | 9.7 | 17.4 | 0.09 | 12 | 135 | 1 | 0.054 | 6.7 | 550 |
| Example 9 | Pressure Roller Overcoat | $Al_2O_3$ | 5.7 | 13.1 | 0.09 | 12 | 135 | 1 | 0.053 | 5.7 | 2100 |
| Comparative Example* | None | | | | | | | | 0.023 | 6.0 | 250 |

TABLE 2

| | | | Receiver Member Characteristics | | | |
|---|---|---|---|---|---|---|
| Sample | Average Kinetic COF | Bricking Subjective Ranking | Gloss 20 Degrees | Average Peak Height | Diameter | #/mm$^2$ |
| Example 1 | 0.50 | 1 | 94 | 0.078 | 5.1 | 450 |
| Example 2 | 0.22 | 1 | 93 | 0.066 | 5.4 | 1500 |
| Example 3 | 0.79 | 7 | 96 | — | — | — |
| Example 4* | 0.39 | 1 | 94 | 0.024 | 5.9 | 2000 |

TABLE 2-continued

| Sample | Average Kinetic COF | Bricking Subjective Ranking | Receiver Member Characteristics: Gloss 20 Degrees | Average Peak Height | Diameter | #/mm$^2$ |
|---|---|---|---|---|---|---|
| Example 5* | 0.60 | 2 | 94 | 0.038 | 4.8 | 250 |
| Example 6 | 0.36 | 1 | 96 | — | — | — |
| Example 7 | 0.32 | 1 | 97 | — | — | — |
| Example 8 | 0.39 | 1 | 96 | — | — | — |
| Example 9 | 0.35 | 1 | 94 | — | — | — |
| Comparative Example* | Locked Sheets | 9 | 96 | 0.028 | 7.0 | 450 |

*Used a threshold of 10 nm in the Veeco analysis.

Methods and Materials

EXAMPLES 1-5

These examples used Micro-Mesh® forming sheets from Micro-Surface Finishing Products, Inc. of Wilton, Iowa. These are available in forms where either silicon carbide or aluminum oxide crystals are suspended in the sheet resin. Cushioning is provided via flexible cotton backing with polymer emulsion cushioning layer. Average roughness, Ra, and average maximum height of the profile, Rz, were measured using a Federal Surfanalyzer 4000 and are given in Table 1. The lead edge of the sheet was attached to the pressure roller. This allowed the sheet to be smoothed out when operating in an operative pressure relationship with the glossing belt. The time of forming was controlled to achieve a given number of cycles of the glosser belt surface.

EXAMPLES 6-7

These examples used non-cushioned sheets. Rather than attaching the forming sheet to the pressure roller, the forming sheet was pulled into the nip formed between the pressure roller and the glossing belt.

EXAMPLES 8-9

These examples used a pressure roller that had been coated with a particulate filled polymer. Two layers of polymer were used. The first layer was 3 mils thick and used aluminum oxide T-61. The second layer was 0.5 mils thick and used aluminum oxide AL-605. The aluminum oxide particles can be obtained from convenient commercial source, e.g., Atlantic Equipment Engineers of Bergenfield, N.J. for AL-605 and Alcoa Inc. for T-61. To control the roughness of the coating on the pressure roller, the time for milling the Al-605 dispersion was varied from 2 to 7 hours for Examples 8 and 9 respectively. The milling time for the T-61 dispersion was kept constant at 7 hours.

The coating solutions were prepared in the following general way. 4.89 grams of aminofunctional polydimethyl siloxane were added to 450 grams of polymer solution and rolled for 3 days. The polymer solution contained fluorocarbon thermoplastic random copolymer THV 220A dissolved in methyl ethyl ketone to achieve 15.5% solids. At the end of three days, 150 grams of the reacted solution were mixed in a milling crock with 6.9 grams of zinc oxide, 69.8 grams of aluminum oxide (AL-605 or T-61 depending on the layer), 125 grams of methyl ethyl ketone, and 24.9 grams of fluoroethylenepropylene (FEP). The crock was rolled on a two-roll mill to form a dispersion. The dispersion and 100 grams of MEK rinse were then added back to the remaining 300 grams of reacted polymer solution. To this combined mixture, a curative solution was added containing 2.093 grams of curative 50 (a bisphenol residue, DuPont) dissolved in 11.3 grams of methyl ethyl ketone. This final coating solution was rolled for 10 minutes. The pressure roller was then coated using a ring coating process. The coated roller was cured in an oven with a 6-hour temperature ramp to 100° C., 2.5-hour ramp to 275° C., 30 minute soak at 275° C., 10 minute cool to 260° C., 2 hour soak at 275° C., and then air cool down to room temperature.

The materials used are all commonly available. THV 220A is a commercially available fluorocarbon thermoplastic random copolymer, which is sold by Dyneon, a 3M Corporation. The aminosiloxane cross-linker #1 and fluoroethylenepropylene D3325B are commercially available from Whitford Corporation of Frazer, Pa.

COMPARATIVE EXAMPLE 1

In Comparative Example 1, the glossing belt was not brought into contact with any abrasive materials.

Coefficient of Friction (COF) Test Method

The COF measurements were carried out on a slip/peel SP-102C-3M90 unit from Instrumentors Inc. The COF value is calculated as follows: Tractive Forces/Normal Forces=Meter Reading/Sled Weight.

The test was performed by placing an ultra-high gloss print image on the test bed. The back of the print image was secured to the test bed via vacuum. Another sample of the ultra-high gloss print was secured to an aluminum sled with the dimensions of 38 mm×53 mm. The test bed with dimensions of 15.25 cm×30.50 cm then traveled at a rate of 6 in/min. The unit digitally recorded a tractive force for the kinetic component of the measurement, which was then divided by the sled weight (39.3 grams) resulting in an average kinetic COF value. The samples were tested at room temperature. ASTM D1894 was used as a rough guide for carrying out the COF test. The print gloss levels from the different examples are given in Table 2 along with the resulting COF values.

Ranking of Bricking Performance

A subjective method was used to evaluate bricking performance. A pile of 50 double-sided prints was glossed and placed on a workbench. The sheets were pressed together firmly by rolling a cold pressure roller across the pile of prints as one would press dough with a rolling pin. The pile of sheets were subjectively evaluated for the amount of force needed to bend it and its' ability to be ruffled back into individual sheets. A ranking between 1 (best) and 10 (worst), was assigned to each pile of sheets relative to other runs within a given experiment.

Definitions

Ra, Rz

Definitions for Ra and Rz can be found at the following web-site or ANSI standards. (http://www.predev.com/smg/parameters.htm)

Gloss

Gloss at 20 degrees follows ASTM D523.

Member and Receiver Member Characteristics:

Member refers to the glossing/fusing belt

Average valley depth, size, and frequency

Receiver Member refers to the fused image print substrate.

Average peak height, size, and frequency

All of the features were measured using equipment from Veeco Instruments, Inc.

Figure 2:
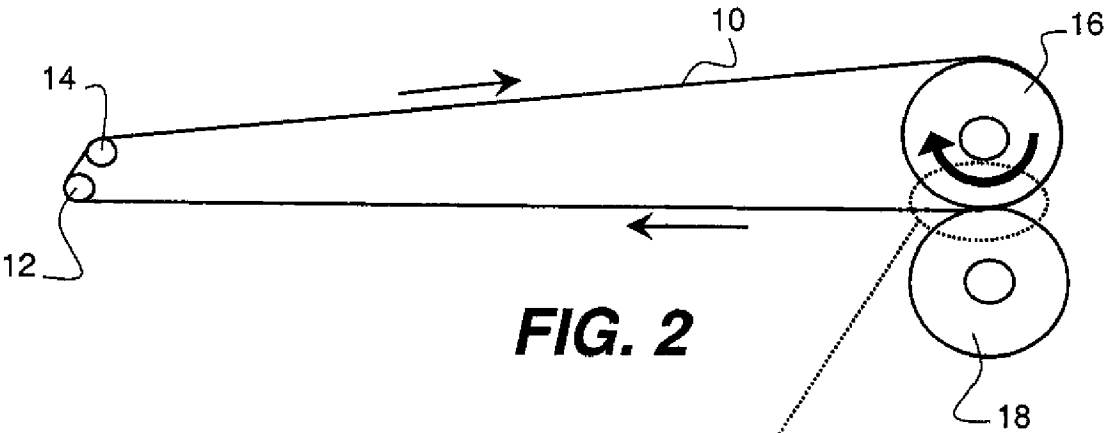
FIG. 2 is an exploded view in perspective of a glossing/fusing belt conditioned with desired features and a receiver sheet with impressed similar features.
Figure 3:
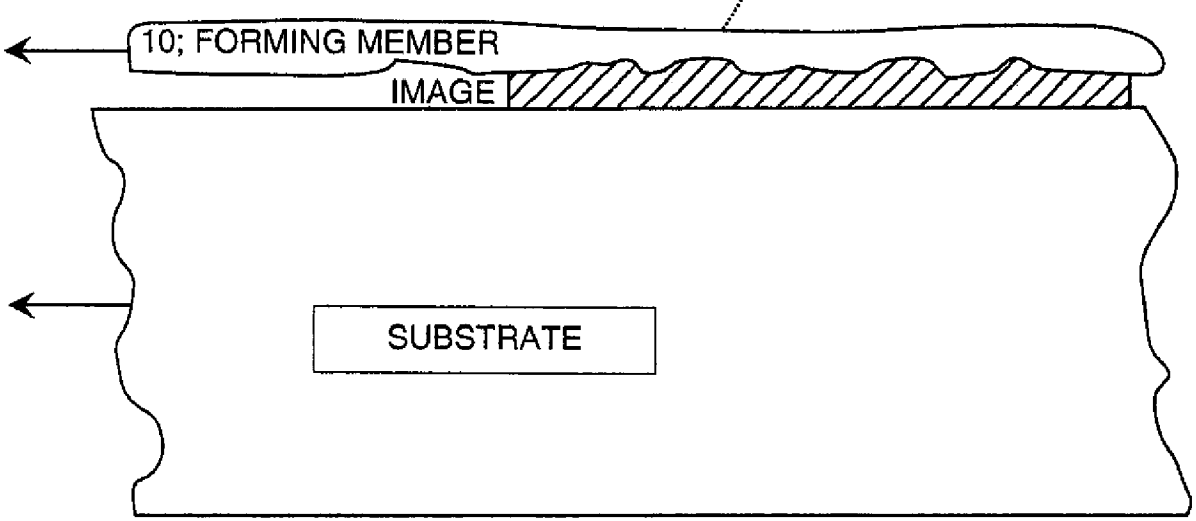
FIG. 3 is a schematic side elevation view of a conditioned glossing/fusing belt forming impressed features on a receiver sheet according to this invention.

Referring to the FIG. 1, a glossing fusing/belt, indicated by the numeral 10, is mounted in a fixture about a series of support rollers 12, 14, and 16. One of the support rollers (e.g., roller 16) is driven to transport the belt 10 in the direction of the associated arrow about a closed loop path. A conditioning roller 18 has an abrasive surface (e.g., cushioned abrasive or sand paper), with features as described above, wrapped thereon. The conditioning roller 18 is selectively moved into positive engagement, with suitable force, into engagement with the belt 10. As the belt moves about the closed loop path, the conditioning roller 18 impresses the surface features into the surface of the belt 10. After approximately six belt revolutions, the features will be suitably formed on the belt 10. Alternatively, the conditioning roller 18 may have a contoured surface containing a particulate filled polymer. Still another alternative is to provide a coating on receiver member substrates with particles, which yield surface features in the previously discussed ranges. Such particle additions may be non-fused toner particles selected from the group consisting of PMMA, PTFE, FEP, and Kynar. After the glossing/fusing belt 10 is prepared as described, it is placed in a glosser/fuser to act on a receiver member (see FIG. 2) to form the appropriate complimentary features on such receiver sheet (see exploded view of FIG. 3) for optimum sheet handling.

The invention has been described in detail with particular reference to certain preferred embodiments thereof, but it will be understood that variations and modifications can be effected within the spirit and scope of the invention.

| PARTS LIST | |
|---|---|
| 10 | Glossing/fusing belt |
| 12, 14, 16 | Support rollers |
| 18 | Conditioning roller |

What is claimed is:

1. A receiver member suitable for having an ultra-gloss image print formed thereon, said receiver member comprising:

at least one planar surface, a plurality of standoffs protruding from said planar surface, said plurality of standoffs in the range of approximately 0.03 to 5.0 μm tall, and in the range of approximately 3.0 to 25.0 μm long providing a coefficient of friction for said planar surface in the range of approximately less than 0.9, and more than 0.5 for substantially preventing similar stacked receiver members from sticking together, and without adversely affecting any print image thereon.

2. The receiver member of claim 1, wherein said standoffs are in the range of approximately 50 to 8,000 per square mm.

3. The receiver member of claim 2, wherein said standoffs are more particularly in the range of approximately 500 to 2,000 per square mm.

4. The receiver member of claim 2, wherein said standoffs are more particularly in the range of approximately 0.05 to 3.0 μm tall.

5. The receiver member of claim 2, wherein said standoffs are more particularly in the range of approximately 4.0 to 10.0 μm long.

6. The receiver member of claim 1, wherein said planar surface further includes a coating, and said standoffs are formed by additions to said coating, said additions being non-fused toner particles selected from the group consisting of PMMA, PTFE, FEP, and Kynar.

7. The receiver member of claim 1, wherein said planar surface further includes a coating, and said standoffs are formed by a reciprocally contoured member brought into pressure contact with a receiver member during the process for forming the ultra-glossy print image.

8. A method for forming a contoured surface on a receiver member having a coating to enable ultra-high gloss print images to be formed thereon, said method comprising the step of:

feeding a receiver member, during the process for forming an ultra-high gloss duplex print images, into pressure contact with a member having a surface contoured to exhibit a plurality of valleys which will not adversely impact a print image, wherein a reciprocal peaked contour is formed on said receiver member.

9. The receiver member of claim 8, wherein said valleys are in the range of approximately 50 to 8,000 per square mm, and more particularly 500 to 2,000 per square mm.

10. The receiver member of claim 9, wherein said reciprocal peaked contour includes a plurality of peaks respectively in the range of approximately 0.03 to 5 μm tall.

11. The receiver member of claim 9, wherein a plurality of peaks are in the range of approximately 3.0 to 25.0 μm long.

12. The receiver member of claim 9, wherein a plurality of peaks are in the range of approximately 0.05 to 3.0 μm tall, and in the range of approximately 4.0 to 10.0 μm long.

13. In a mechanism for forming ultra-glossy, duplex print images on a receiver member, a member for creating a contour on the receiver member to substantially prevent stacked receiver members from sticking together while not adversely affecting the quality of the print images, said member comprising:

a surface contoured to exhibit a plurality of valleys which will not adversely impact print image quality, wherein a reciprocal peaked contour is formed on said receiver member.

14. The member of claim 13, further including a contoured surface containing a particulate filled polymer.

15. The member of claim 13, wherein said valleys are in the range of approximately 50 to 8,000 per square mm.

16. The receiver member of claim 15, wherein said valleys are more particularly in the range of approximately 500 to 2,000 per square mm.

17. The member of claim 15, wherein said valleys are in the range of approximately 0.03 to 5.0 μm deep.

18. The member of claim 15, wherein said valleys are in the range of approximately 3.0 to 25.0 μm long.

19. The member of claim 15, wherein said valleys are in the range of approximately 0.04 to 3.0 μm deep, and in the range of approximately 4.0 to 10.0 μm long.

20. In a mechanism for forming ultra-glossy, duplex print images on a receiver member, a member for creating a contour on the receiver member to substantially prevent stacked receiver members from sticking together while not adversely affecting the quality of the print images, a method for forming said member comprising the steps of:

providing a forming sheet including a surface contoured to exhibit a plurality of peaks which will not adversely impact print image quality;

supporting said forming sheet on a roller;

bringing said forming sheet on said roller into pressure relation with a glossing belt; and moving said glossing belt and forming sheet in operative pressure relation for a time sufficient to transfer a reciprocal valley contour is formed on said glossing belt, wherein said glossing belt will form a reciprocal contour on a receiver sheet to substantially prevent stacked receiver members from sticking together while not adversely affecting the quality of the print images.

* * * * *